US006418953B1

(12) United States Patent
Novotny

(10) Patent No.: US 6,418,953 B1
(45) Date of Patent: Jul. 16, 2002

(54) CANOPY SYSTEM

(75) Inventor: John T. Novotny, 11811 Ave. of the PGA 1-1c, Palm Beach Gardens, FL (US) 33418

(73) Assignee: John T. Novotny, Palm Beach Gardens, FL (US)

( * ) Notice: Subject to any disclaimer, the term of this patent is extended or adjusted under 35 U.S.C. 154(b) by 0 days.

(21) Appl. No.: 09/587,395

(22) Filed: Jun. 5, 2000

(51) Int. Cl.[7] ..... E04H 15/34

(52) U.S. Cl. ..... 135/156; 135/90; 135/97; 135/121; 135/122; 135/912

(58) Field of Search ..... 135/122, 908, 135/912, 97, 156, 90, 121, 21

(56) References Cited

U.S. PATENT DOCUMENTS

| | | | | | |
|---|---|---|---|---|---|
| 627,932 | A | * | 6/1899 | Hickson | 135/156 |
| 2,002,296 | A | * | 5/1935 | Pope | 135/912 |
| 2,513,729 | A | * | 7/1950 | Lemen | 135/122 |
| 2,764,107 | A | * | 9/1956 | Niswonger et al. | 135/97 X |
| 3,131,705 | A | * | 5/1964 | Marino | 135/912 X |
| 3,222,067 | A | * | 12/1965 | Litwhiler et al. | 135/97 X |
| 3,383,127 | A | * | 5/1968 | Grunfeld | 135/121 X |
| 3,534,511 | A | * | 10/1970 | Cappella | 135/912 X |
| 3,909,993 | A | * | 10/1975 | Huddle | 135/156 X |
| 3,943,953 | A | * | 3/1976 | Cantwell et al. | 135/156 |
| 4,209,068 | A | | 6/1980 | Coresntino | 172/572 |
| 4,683,901 | A | * | 8/1987 | Mitchell | 134/97 |
| 4,683,902 | A | * | 8/1987 | Wilson | 135/105 |
| 4,898,198 | A | | 2/1990 | Castlebury | 135/90 |
| 4,948,289 | A | | 8/1990 | Dellinger | 403/246 |
| 5,575,301 | A | | 11/1996 | Bolton | 135/122 |
| 5,584,311 | A | * | 12/1996 | Schaefer | 135/121 X |
| 5,638,848 | A | * | 6/1997 | November | 135/156 X |
| 5,732,726 | A | * | 3/1998 | Lee | 135/156 |
| D408,085 | S | | 4/1999 | Dattner | D25/56 |
| 5,967,162 | A | | 10/1999 | Bolton | 135/122 |

OTHER PUBLICATIONS

It's mid–July, High Noon and the Sun's Fury Just Sent the Mercury Past 100, Covershots™ Brochure w/price list.
Innovative, Versatile and Profitable, Covershots™ Brochure.
Solar System Range Shelters brochure for Fiesta Tents, Ltd. and price list, 1999.

* cited by examiner

*Primary Examiner*—Robert Canfield
(74) *Attorney, Agent, or Firm*—Saul Ewing LLP

(57) ABSTRACT

A mobile canopy system providing shelter from the sun, rain, and wind. The canopy system contains at least two canopy system sections, each containing one centrally located support structure. A truss system is attached to the support structure, perpendicularly extending the length of the canopy system section. Canopy framing systems are perpendicularly connected to, and intervally spaced along, the truss system. Cross bars are perpendicularly connected to the ends of the canopy framing systems, extending the length of the canopy system section. The canopy lies in an inclined plane, suspended from the cross bars, providing adequate clearance for underlying activities including golf. The inclined canopy, suspended below the truss system and canopy framing systems, provides absorbing and deflective protection to the user from errantly hit objects, whereby the canopy absorbs the force of the errant object and deflects the object out and away from the participant under the canopy system. An additional, retractable vertical canopy system provides further protection from high wind, driving rain, and early morning or late afternoon sun.

19 Claims, 7 Drawing Sheets

CANOPY SYSTEM

FIELD OF THE INVENTION

The present invention relates generally to a canopy system, and more particularly to a protection system for golfers at driving ranges, providing tee area shelter, being equally suited for any activity where the participants are stationary or confined to an area.

BACKGROUND OF THE INVENTION

Canopy systems have been developed in the past for awning and tent-like applications, providing protection for such things as children's playsets, vehicles, small gatherings, and specific worker applications. Mobile canopy shelters also exist for some of these applications, however, few canopy systems exist that shelter numerous people participating in outdoor activities such as golf.

Information relevant to attempts to address canopy systems for golfers can be found in U.S. Pat. Nos. 5,967,162 and 5,575,301. However, each of these references suffers from one or more disadvantages.

First, the canopy of these systems is installed over the supporting structure, forming an arch. This design allows animals to nest under the canopy in the supporting structure. This design also allows errantly hit objects, such as golf balls, to bounce about the structure and deflect back, possibly injuring the participants below.

The present invention solves these problems by providing a canopy installed in an inclined horizontal plane, below the canopy supporting structure. This design prevents animals from nesting and deflects errantly hit objects out and away from the sheltered participants.

Second, the past canopy systems are end-supported, requiring that the span support members (connecting the end-supports) are designed to support the entire canopy system, since they span the entire length. In contrast, the present invention includes independent canopy system sections, each with a centrally located ground support structure. The span support members of the present invention are, therefore, considerably shorter than those of end-supported canopy systems of similar length, since they span no greater than half the canopy system length.

The advantage of this design is structural economy, as the span support members are smaller and fewer in number. Weighing less, the present invention is more mobile and less expensive. Also, a smaller structure is less obtrusive and more aesthetically pleasing.

Third, the end-supports of the past canopy systems provide no flexibility in canopy system length; the consumer is limited to the length of the system as manufactured. In contrast, the independent canopy system sections of the present invention, each with a centrally located ground support structure, provide flexibility in overall canopy system length. The canopy system sections can be connected end to end and continued indefinitely, providing the consumer flexibility in attaining desired lengths, maximizing overall lengths, and extending canopy system lengths after initial purchase.

Finally, the present invention is superior to all previous systems in that it provides a vertical canopy arrangement providing greater protection from high wind, driving rain, and early morning or late afternoon sun, than related canopy systems.

SUMMARY OF THE INVENTION

The present invention is directed to a mobile, free standing canopy system, providing shelter from the elements while not subjecting the individuals underneath to injury by the deflection of errantly hit objects. This invention is also directed to a less expensive, more mobile, and more aesthetically pleasing canopy system for activities such as golf.

In one embodiment of the canopy system, at least two canopy system sections are connected end to end, each with one, centrally located support structure mounted on wheels. A truss system is attached to the support structure, perpendicularly extending the length of the canopy system section. Canopy framing systems are perpendicularly connected to, and intervally spaced along, the truss system. Cross bars are perpendicularly connected to the ends of the canopy framing systems, extending the length of the canopy system section. A canopy is suspended from the cross bars in an inclined horizontal plane, below the truss system and the canopy framing systems, providing adequate clearance for underlying activities, including golf An additional, retractable vertical canopy system provides further protection from high wind, driving rain, and early morning or late afternoon sun. The vertical canopy system is sectionally coiled and enclosed, with an enclosure supported on each vertical canopy support member, spaced at intervals that provide easy manual connection or retraction, as individually desired.

In a second embodiment of the invention the support structure is not centrally located within each canopy system section. In a third embodiment of the invention, the canopy system does not require at least two canopy system sections, as the canopy system is free-standing, including at least two support structures. In a fourth embodiment of the invention the canopy is not inclined. A fifth embodiment of the invention includes self-supporting, free-standing structure to support the canopy system, and framing members connected to the free-standing structure to support a canopy. The canopy is suspended from the framing members, whereby the framing members are not exposed to participants underneath.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
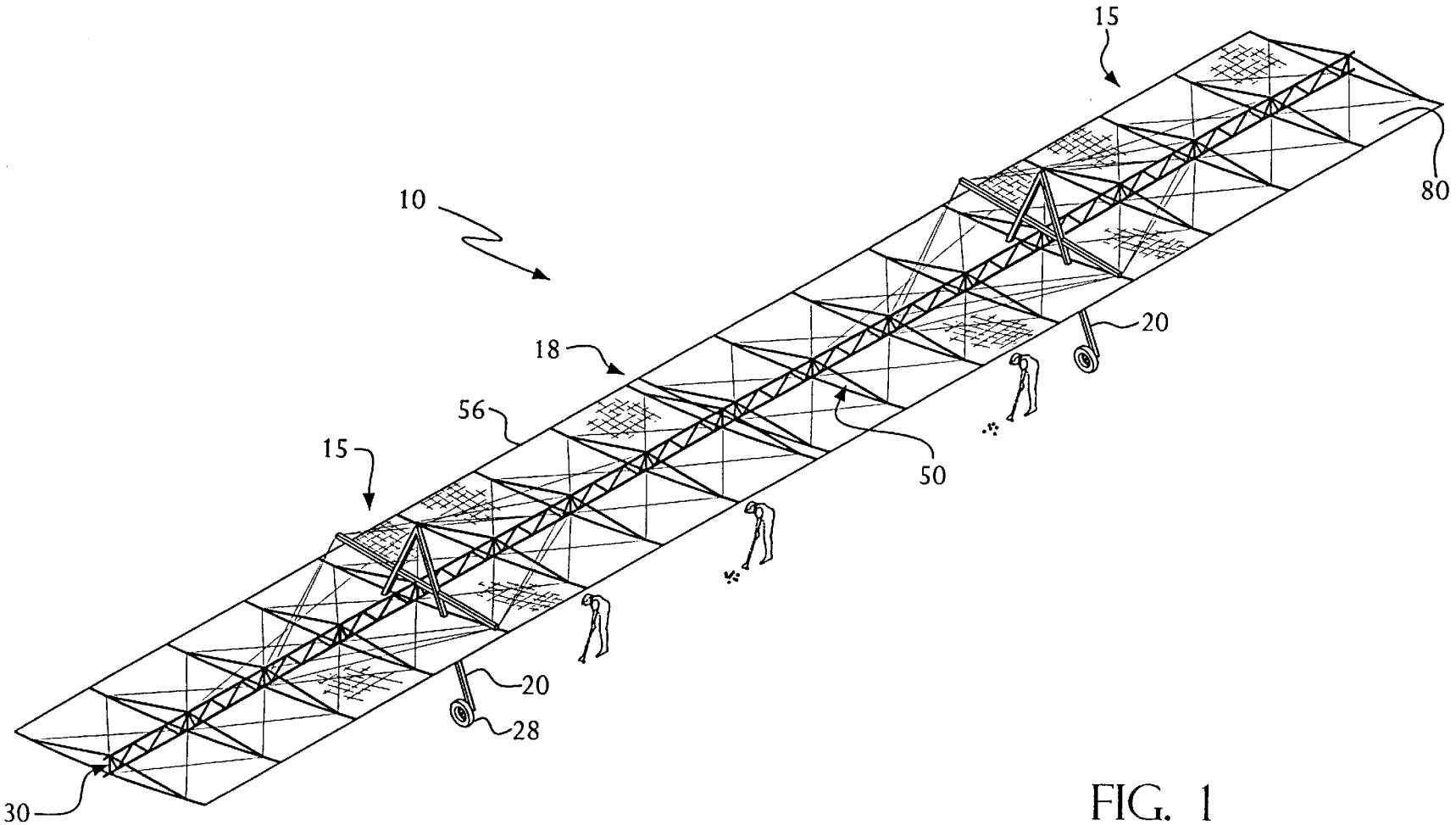
FIG. 1 illustrates a perspective view of a canopy system according to one embodiment of the present invention.

Referring now to the drawings, wherein like numerals indicate like elements, there is shown in FIG. 1 an illustration of a perspective view of a canopy system 10. The canopy system 10 contains at least two canopy system sections 15, connected at adjoining ends for free-standing self-support. Each canopy system section 15 contains one support structure 20, which can be mounted on wheels 28.

A truss system 30 is supported by the support structure 20 and extends the length of each canopy system section 15. The truss system 30 supports multiple canopy framing systems 50, perpendicularly aligned at intervals along the truss system 30. Cross bars 56, aligned parallel to the truss system 30, are connected at each end of the multiple canopy framing systems 50. The canopy 80 is supported by, and suspended from, the cross bars 56. The truss system 30, the canopy framing systems 50, and the cross bars 56, make up the framing members of the canopy system 10.

Figure 2:
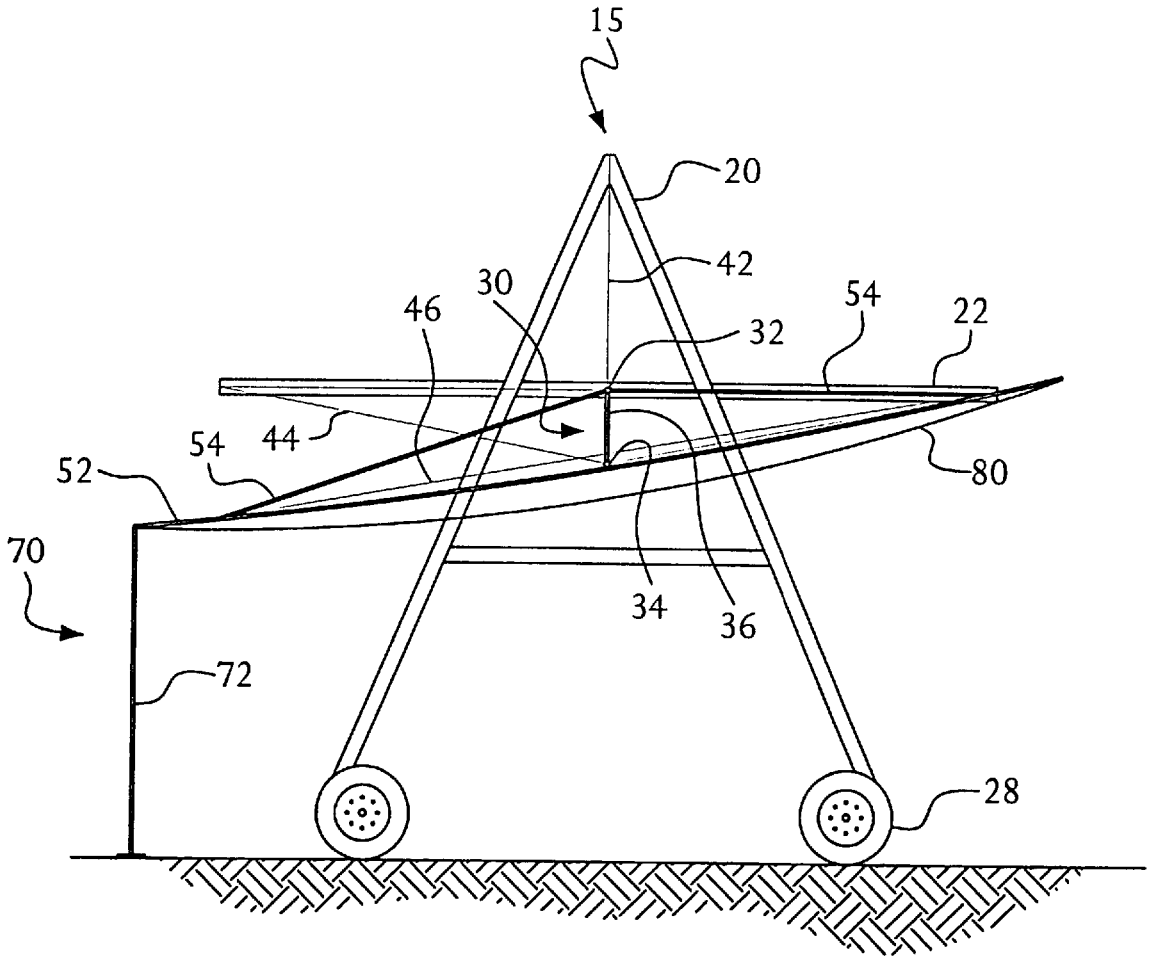
FIG. 2 illustrates a left elevation view of the canopy system shown in FIG. 1.

FIG. 2 is a left elevation view of the canopy system 10 shown in FIG. 1, illustrating the components of the support structure 20, the canopy framing system 50, and the truss system 30. The support structure 20 is shaped as an "A"-frame and contains a horizontal support member 22, both can be made of tubular steel. The horizontal support member 22 lies in the same plane as, and extends in each direction just beyond the base of, the support structure 20. The horizontal support member 22 is positioned high enough above the ground to provide adequate clearance beneath the canopy system 10 for activities such as golf.

The truss system 30, aligned perpendicular to the plane of the support structure 20, comprises a top chord 32 in vertical alignment with a bottom chord 34, which can be but is not limited to "schedule 80" steel pipe. The top chord 32 and the bottom chord 34 are connected and reinforced by the vertical and diagonal members of web 36, which can be smaller diameter "schedule 40" steel pipe. The top chord 32 is connected to the center of the horizontal support member 22. The bottom chord 34 continues through the support structure 20, underneath the horizontal support member 22.

The canopy framing systems 50 are each comprised of a lower framing member 52 and a framing support member 54. The lower framing member 52 lies in an inclined horizontal plane, with the front of the canopy system 10 (opening to the area of play) higher than the back of the canopy system 10. The lower framing member 52 can be "schedule 40" steel pipe and is centrally connected to the bottom chord 34. Pipe connections can be bolted, welded, or otherwise suitably secured.

The outer ends of the lower framing member 52 are supported by a framing support member 54. The framing support member 54 can be stainless steel cable, steel pipe, or other suitable material. If the framing support member 54 is made of cable, connection to the lower framing member 52 is achieved by cable looping over a hook, or through an eyelet attached to the lower framing member 52. If the framing support member 54 is made of "schedule 40" steel pipe, welded connections can be made to the top chord 32 and to the lower framing member 52.

The canopy 80 can be aligned in an inclined plane and is positioned vertically below the canopy framing system 50 and the truss system 30. The configuration of the present invention protects the user from a variety of hazards including the prevention of errantly hit balls or objects from being captured beneath the canopy system 10. This unique and novel feature prevents objects from being deflected by otherwise exposed structure, possibly injuring participants. Instead, errant objects immediately hit the canopy 80 where their energy or force is partially absorbed, rendering the object harmless. Any remaining force is deflected out and away from the striker by the inclined plane of the canopy 80.

FIG. 2 also illustrates an optional vertical canopy system 70, showing one vertical canopy support member 72 which can comprise but is not limited to square aluminum bars. The top of the vertical canopy support member 72 is connected to the end of the lower framing member 52.

Figure 3:
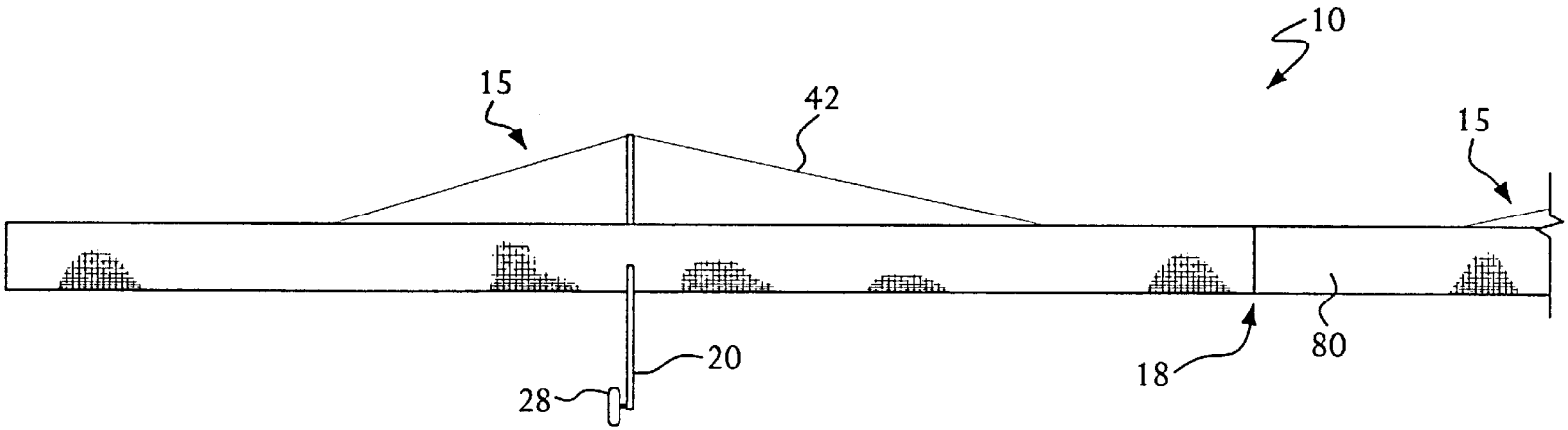
FIG. 3 illustrates a front elevation view of the canopy system shown in FIG. 1.

FIG. 3 shows a front elevation of one complete canopy system section 15 of canopy system 10 connected to an adjoining canopy system section 15 (shown in partial view) at a connection point 18. Although the preferred embodiment includes at least two canopy system sections 15, it is to be understood that one or several canopy system sections 15 may be used. Alternative embodiments of the present invention might include one canopy system 10 without connections. FIG. 3 illustrates the canopy 80 below the truss system 30 and the canopy framing systems 50, shielding the truss system 30 and the canopy framing systems 50 from a user beneath the canopy system 10.

Figure 4:
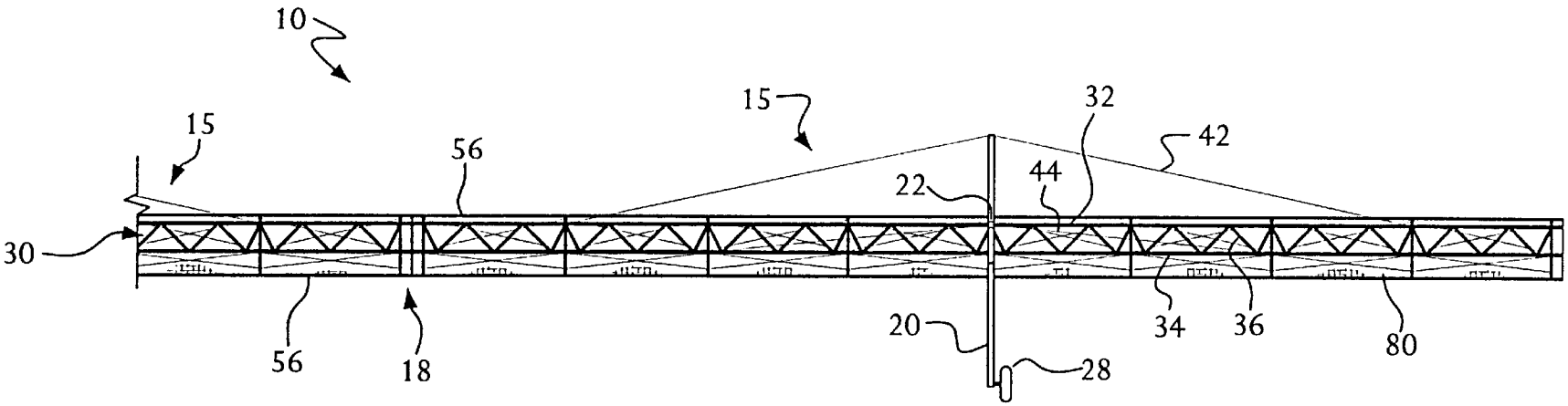
FIG. 4 illustrates a back elevation view of the canopy system shown in FIG. 1.

FIG. 4 shows a back elevation of one complete canopy system section 15 of canopy system 10 connected to an adjoining canopy system section 15 (shown in partial view) at a connection point 18. The support structure 20 is centrally located within the canopy system section 15, supporting the truss system 30. Although the preferred embodiment shows the support structure 20 centrally located within the canopy system section 15, it is to be understood that the support structure 20 is not limited to a central location within the canopy system section 15. Alternative embodiments might have the support structure 20 located anywhere along the canopy system section 15.

FIG. 4 illustrates the vertical and diagonal members of web 36, connecting and reinforcing the top chord 32 with the bottom chord 34 of truss system 30. The truss system 30 is further supported by a vertical bracing cable 42 attached to the top of the support structure 20 and extending to the top chord 32 on each side of the support structure 20. Twisting is prevented by torsional bracing cables 44, attached at each end of the horizontal support member 22 and separately extending to the top chord 32 and to the bottom chord 34 on each side of the support structure 20. The vertical bracing cable 42 and torsional bracing cables 44 can be stainless steel and are stressed taut during installation to resist vibration and flutter due to wind.

FIG. 4 shows the connection (at a connection point 18) of two adjacent canopy system sections 15. The connections can be made at either end of canopy system section 15, and canopy system sections 15 can be continued indefinitely, providing flexibility in attaining desired lengths, maximizing overall lengths, and extending canopy system 10 lengths after initial purchase. In addition, canopy system sections 15 are fabricated in varying lengths to further accommodate recreational facility layouts. Connection of adjacent canopy system sections 15 entails attachment of the top chord 32 and the bottom chord 34 to that of the adjacent canopy system section 15 (detailed in FIG. 9), along with the attachment of respective cross bars 56 at the front and back of each canopy system section 15 (detailed in FIG. 9).

Figure 5:
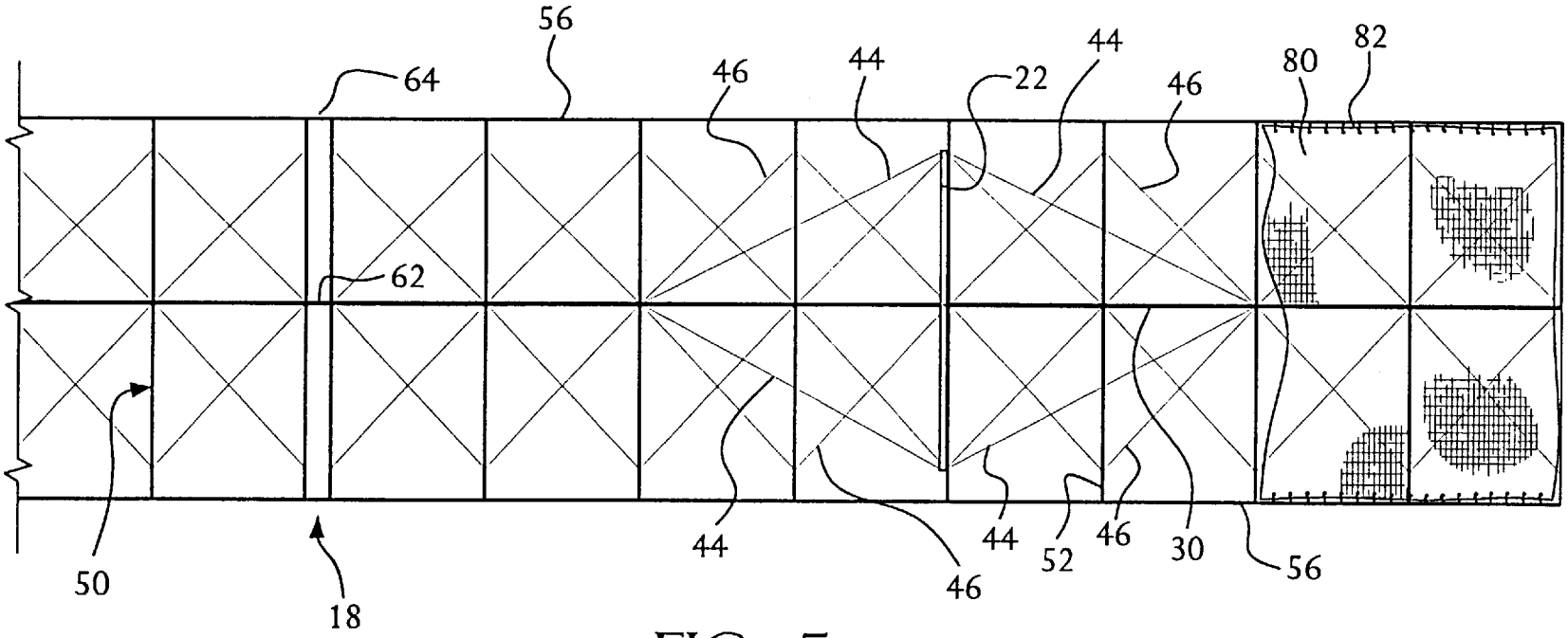
FIG. 5 illustrates a plan view of the canopy system shown in FIG. 1.

FIG. 5 shows a plan view of one complete canopy system section 15 of canopy system 10 connected to an adjoining canopy system section 15 (shown in partial view) at a connection point 18. FIG. 5 shows the symmetrical layout of individual canopy framing systems 50, perpendicularly spaced at intervals along truss system 30. The preferred interval distance is 10 feet, but no specific distance is required.

The cross bars 56 are attached at the end of, and are aligned perpendicular to, each lower framing member 52. The cross bars 56 extend the length of canopy system section 15, and provide for the attachment of the canopy 80, a portion of which is shown herein. The canopy 80 is attached to the cross bars 56 with canopy ties 82.

FIG. 5 shows a horizontal lacing cable 46, securing and reinforcing individual canopy framing systems 50 to each other. The horizontal lacing cable 46 attaches to the outer end portions of each lower framing member 52 with diagonal lacing through the truss system 30. To increase rigidity and stiffness, the horizontal lacing cables 46 can also be attached to each other, and/or the truss system 30, at each point of horizontal lacing cable 46 intersection.

FIG. 5 provides an overall plan view of the torsional bracing cables 44 and illustrates the connection of the cross bars 56 and the truss system 30 at a canopy system section 15 connection point 18.

Figure 6:
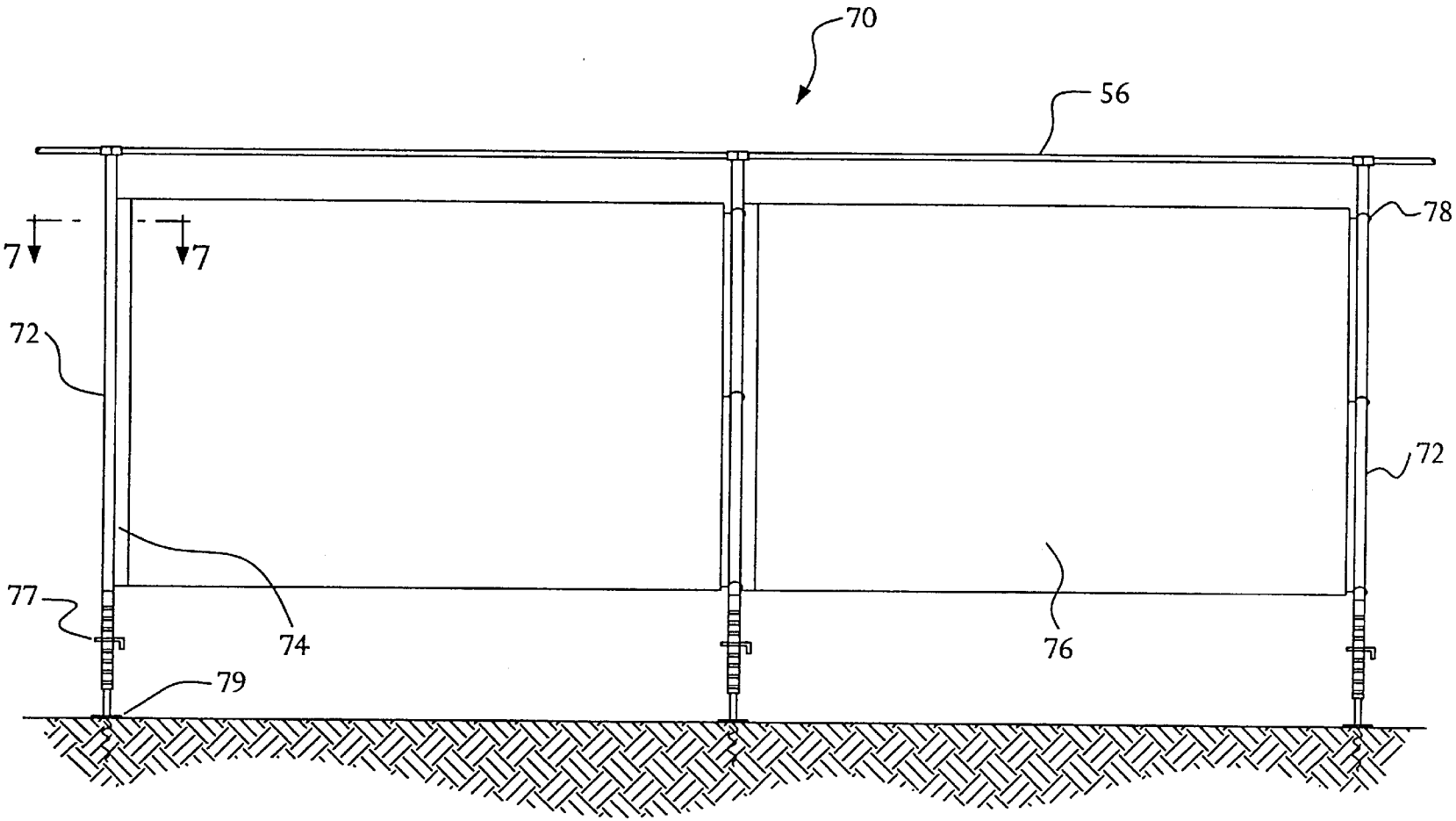
FIG. 6 illustrates an elevation view of a vertical canopy system of the canopy system of the present invention.

FIG. 6 shows an elevation view of the vertical canopy system 70. The vertical canopy support members 72 are spaced at intervals that align with that of the lower framing members 52 (not shown). The bottom of each vertical canopy support member 72 is secured to the earth by an auger 79, or similar device. A telescoping adjustment 77 is provided for the individual height adjustment of the vertical canopy support members 72. The telescoping adjustment 77 can be two telescoping portions of dissimilarly sized aluminum bars, with bolt-thru fastening.

FIG. 6 shows the vertical canopies 76 uncoiled and in use, individually attached by hooks 78 to its respective, adjacent, vertical canopy support member 72. A vertical canopy enclosure 74 is included and attached to each vertical canopy support member 72, to house the vertical canopy 76 if use is not desired. Each participant can individually connect or retract the vertical canopy 76 over their individual portion of canopy system 10 use.

Figure 7:
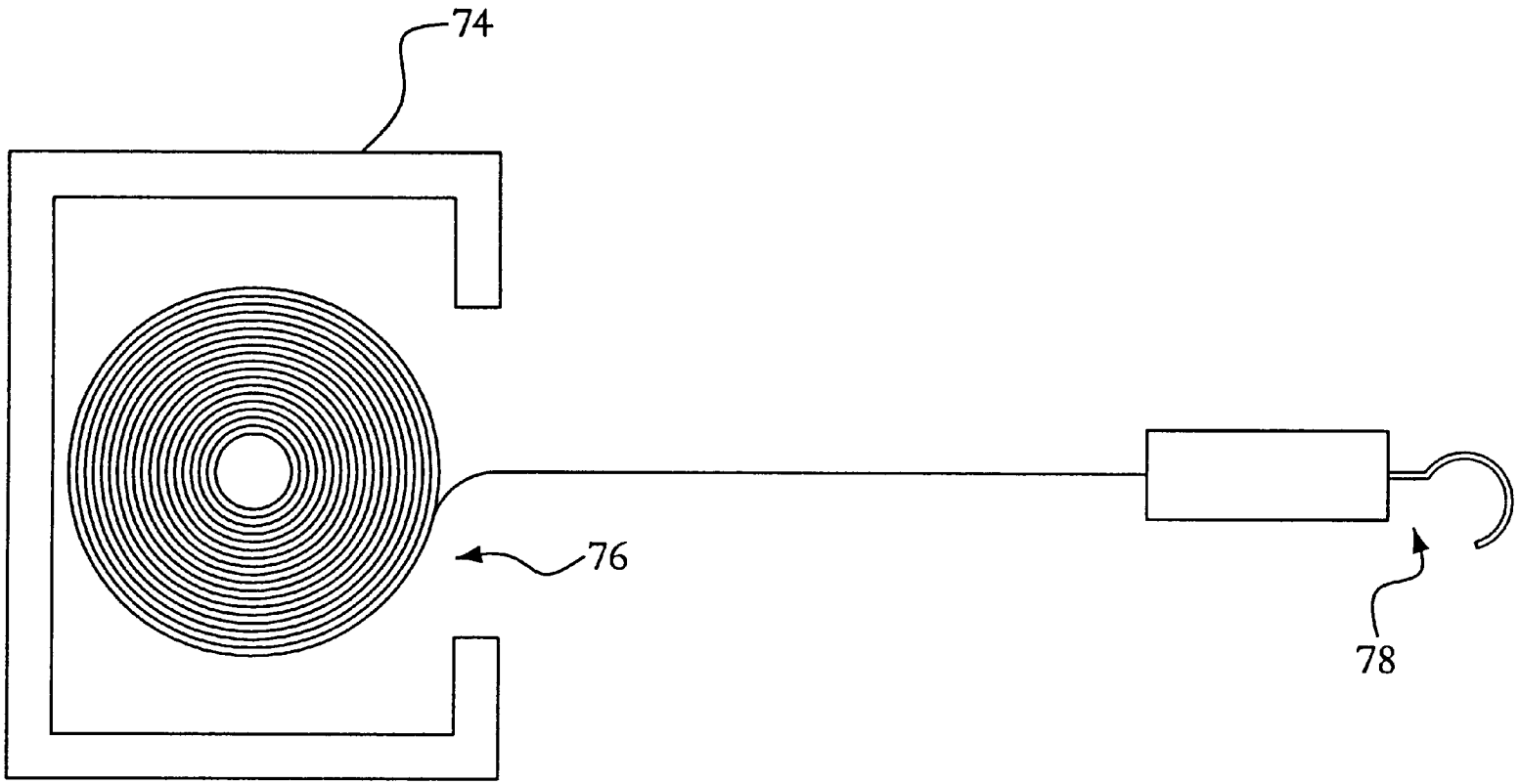
FIG. 7 illustrates a cross-section plan detail of a coiled vertical canopy of the vertical canopy system shown in FIG. 6.

FIG. 7 details a cross-sectional plan view of the vertical canopy system enclosure 74, showing a coiled vertical canopy 76. The vertical canopy 76 is manually operational, with hook 78 providing for easy uncoiling and attachment to the adjacent vertical canopy support member 72.

Figure 8:
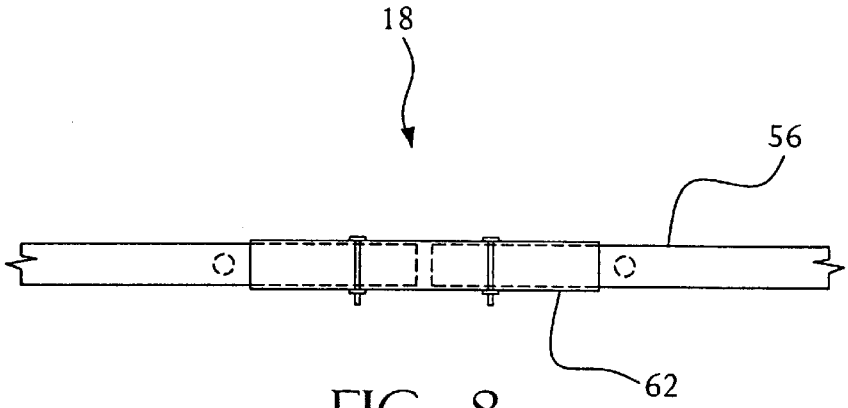
FIG. 8 illustrates is an elevation detail of a cross bar sleeve connection for connecting canopy system sections of the canopy system shown in FIG. 1.
Figure 9:
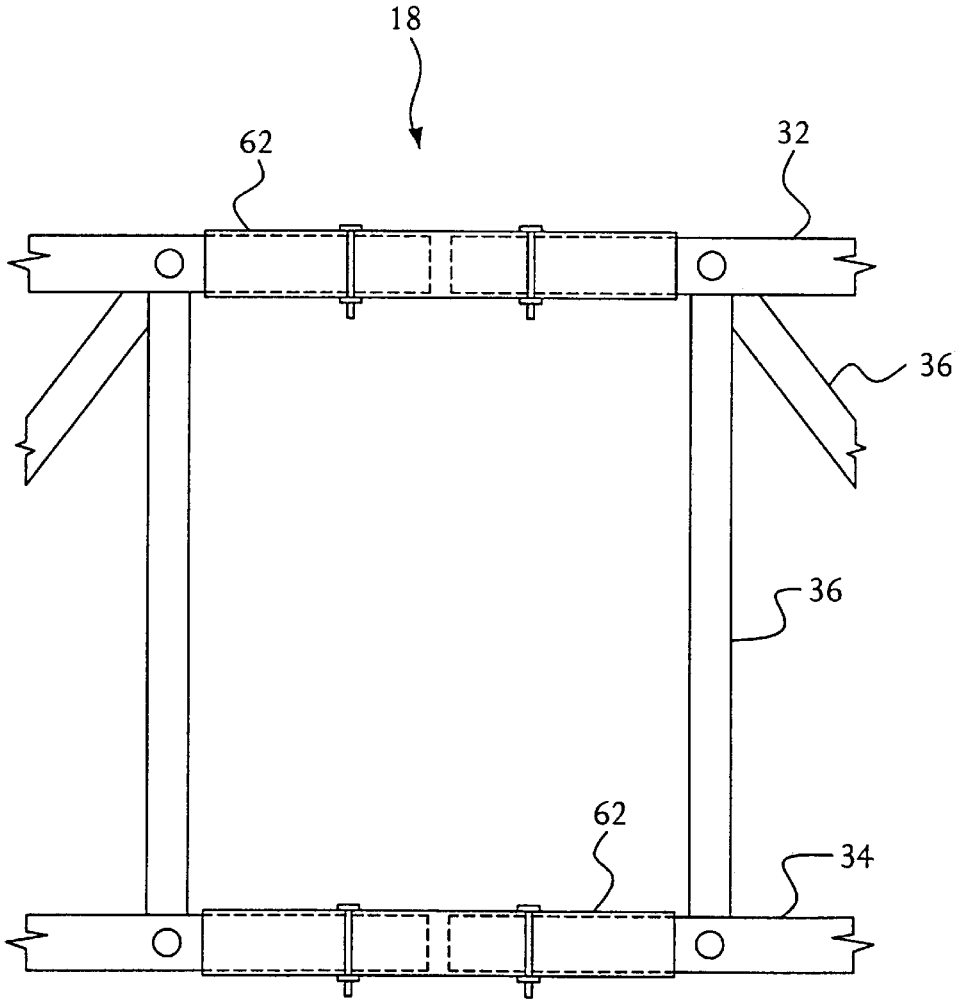
FIG. 9 illustrates is an elevation detail of a chord sleeve connection for connecting canopy system sections of the canopy system shown in FIG. 1.

FIGS. 8 and 9 show connection point 18 details for adjacent canopy system sections 15 of the canopy system 10. FIG. 8 details the connection of the cross bars 56, using a cross bar sleeve connector 64. The cross bar sleeve connector 64 can be "schedule 80" steel pipe with a slightly larger diameter than the cross bars 56. The cross bar sleeve connector 64 receives each end of the cross bar 56 being connected, with a bolt-thru fastener securing the attachment. The cross bar sleeve connector 64 must be long enough to provide a high strength attachment, resisting the wind's bending stresses.

FIG. 9 details the connection of the top chord 32 and the bottom chord 34 of the truss system 30, using a chord sleeve connector 62. The chord sleeve connector 62 is similar to the cross bar sleeve connector 64, except that the chord sleeve connector 62 has a larger diameter to accept the larger diameter of the top chord 32 and the bottom chord 34. FIG. 9 shows that the web 36 does not extend through the connection.

In most applications, canopy system erection takes place on location. When using cable for the framing support members 54, the cable is first slidably secured across the top of the top chord 32. To ensure overall canopy framing system 50 stiffness and rigidity, the cable is pre-stressed before attachment to each outer portion of the lower framing member 52. Pre-stressing occurs using a slightly shorter than necessary length of cable for the framing support member 54, and bending the ends of the lower framing member 52, about the bottom chord 34, to accept connection with the taut cable of the framing support member 54. The canopy framing system 50 is then rotatably adjusted about the truss system 30, aligning the canopy 80 front end and back end heights. Upon achieving the desired canopy 80 taper, the center of the lower framing member 52 is bolted or pinned to the bottom chord 34, and the cable of the framing support member 54 is clamped to the top chord 32. This installation practice accommodates differing site conditions, such as unlevel terrain, prevailing winds, water run-off concerns, etc.

In some applications, it might be desirable to secure the bottom of the support structure 20 to the ground to account for the affects of wind uplift. In these situations, the wheels 28 may or may not be removed. The wheels 28 shall be of sufficient size to support the structure and provide for easy mobility, with all or some of the wheels 28 being pivotable. The wheels 28 can be motorized, providing mobility without towing equipment. However, in most applications, simply attaching the support structure 20 to lawn maintenance equipment will provide mobility.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed:

1. A canopy system comprising:

a. at least two canopy system sections, each having a length, a front, a back, and two ends having;
   i. a support structure,
   ii. a truss system extending for the length, in communication with the support structure,
   iii. a plurality of canopy framing systems, each in communication with the truss system at intervals along the length, and
   iv. a plurality of cross bars in communication with the canopy framing systems, the cross bars extending for the length along the front and the back, b. at least one connector attaching the canopy system sections; and c. a canopy which is supported by and connected to the cross bars.

2. A canopy system as in claim 1, wherein the canopy is positioned below the truss system and the canopy framing systems whereby the truss system and the canopy framing systems are not exposed to individuals under the canopy system.

3. A canopy system as in claim 1, wherein a plurality of wheels is connected to the support structure.

4. A canopy system as in claim 1, wherein the truss system comprises a top chord and a bottom chord, the bottom chord lying in a vertical plane below the top chord, and a web, vertically and diagonally connecting and bracing the top chord to the bottom chord.

5. A canopy system as in claim 1, wherein each of the canopy framing systems comprises:

a. a lower framing member extending from the front to the back, centrally connected to a bottom of the truss system; and b. a framing support member centrally connected to a top of the truss system and extending towards the front and the back, connecting to and supporting the lower framing member.

6. A canopy system as in claim 5, wherein the framing support member consists of steel cable.

7. A canopy system as in claim 1, further including a retractable, vertical canopy system, comprising:

a. a plurality of vertical canopy support members;

b. a plurality of vertical canopy enclosures; and c. a plurality of vertical canopies, each coiled within one of the vertical canopy enclosures, whereby each of the vertical canopies is uncoiled and attached to one of the vertical canopy support members.

8. A canopy system as in claim 1, wherein the support structure is an "A"-frame.

9. A canopy system as in claim 8, wherein the "A"-frame support structure further includes a horizontal support member, the horizontal support member supports the truss system through connection therewith.

10. A canopy system as in claim 1, further comprising a vertical bracing cable, providing support for the truss system, the vertical bracing cable extending, in each canopy system lengthwise direction, from a top of the support structure to a top of the truss system, with connection therewith.

11. A canopy system as in claim 9, further comprising torsional bracing cables, providing support for the truss system, the torsional bracing cables extending, in each canopy system lengthwise direction, from a front end and from a back end of the horizontal support member to a top of the truss system and to a bottom of the truss system, with connection therewith.

12. A canopy system as in claim 1, further comprising torsional bracing cables, providing support for the truss system, the torsional bracing cables extending, in each canopy system lengthwise direction, from a front of and from a back of the support structure to a top of the truss system and to a bottom of the truss system, with connection therewith.

13. A canopy system as in claim 5, further comprising a horizontal lacing cable providing support for the lower framing members.

14. A canopy system as in claim 1, further comprising a horizontal lacing cable providing support for the canopy framing systems.

15. A canopy system as in claim 1, wherein the canopy is suspended in an inclined horizontal plane below the truss system and the canopy framing systems.

16. A canopy system as in claim 1, wherein the support structure is centrally located within each of the canopy system sections.

17. A canopy system having a length, comprising:

a. a two canopy system sections, each section having a centrally located support structure, the two support structures separated by a distance, wherein the distance is about one-half the length of the canopy system;

b. framing members, in communication with the support structures, to support a canopy over the length of the canopy system; and c. a canopy connected to the framing members.

18. A canopy system, comprising:

a. support structure to support the canopy system;

b. framing members in communication with the support structure to support a canopy over a length of the canopy system; and c. a canopy connected to the framing members, wherein the canopy is suspended from, and positioned below, the framing members to deflect errantly hit objects out and away from individuals beneath the canopy system.

19. A canopy system having a length and a plurality of sides, comprising:

a. support structure to support the canopy system;

b. framing members in communication with the support structure to support a canopy over the length of the canopy system; and c. a canopy connected to the framing members, wherein the canopy is suspended from, and positioned below, the framing members, the canopy absent from at least one side of the canopy system, whereby the framing members are not exposed to individuals under the canopy system and individuals under the canopy system can hit objects out from under the canopy system.

* * * * *